US005980200A

United States Patent [19]

Rollwage et al.

[11] Patent Number: 5,980,200

[45] Date of Patent: Nov. 9, 1999

[54] PERIPHERAL PUMP, IN PARTICULAR FOR FEEDING FUEL FROM FEED TANK TO INTERNAL COMBUSTION ENGINE OF MOTOR VEHICLE

[75] Inventors: Mathias Rollwage, Ditzingen; Peter Schelhas, Stuttgart; Dietmas Schmieder, Möglingen; Klaus Baier, Ditzingen, all of Germany

[73] Assignee: Robert Bosch GmbH, Stuttgart, Germany

[21] Appl. No.: 08/804,943

[22] PCT Filed: May 28, 1996

[86] PCT No.: PCT/DE96/00919

§ 371 Date: Feb. 24, 1997

§ 102(e) Date: Feb. 24, 1997

[87] PCT Pub. No.: WO97/05393

PCT Pub. Date: Feb. 13, 1997

[30] Foreign Application Priority Data

Aug. 1, 1995 [DE] Germany ..... 195 20 181

[51] Int. Cl.[6] ..... F04D 5/00

[52] U.S. Cl. ..... 415/55.1; 415/55.4

[58] Field of Search ..... 415/55.1, 55.2, 415/55.3, 55.4, 55.5, 55.6, 55.7, 104, 107

[56] References Cited

U.S. PATENT DOCUMENTS

| | | | |
|---|---|---|---|
| 4,673,333 | 6/1987 | Kluge | 415/55.4 |
| 4,692,092 | 9/1987 | Matsuda et al. | 415/55.1 |
| 4,844,621 | 7/1989 | Umemura et al. | 415/55.5 |

FOREIGN PATENT DOCUMENTS

| | | | |
|---|---|---|---|
| 4209126 | 11/1992 | Germany | 415/55.1 |

*Primary Examiner*—Christopher Verdier
*Attorney, Agent, or Firm*—Michael J. Striker

[57] ABSTRACT

A peripheral pump for feeding fuel from a supply tank to the internal combustion engine of a motor vehicle, in which, in a pump chamber (17) embodied by at least two adjacent walls (18, 19), a revolving circular-cylindrical impeller (12) is disposed, on whose face end in an intake-side wall (18) and an outlet-side wall (19) of a medium a feed conduit (41, 42) is provided, which communicate with one another at an angle (β) via a radially disposed connecting conduit (49, 51) in the wall (18, 19) having a pressure region (34, 35) cooperating with the impeller (12), and these pressure regions (34, 35) can be acted upon by the pressure building up increasingly in the feed conduit (41, 42), thus bringing about an equalization of axial force with respect to the impeller (12) at the walls (18, 19) of the pump chamber (17).

11 Claims, 2 Drawing Sheets

PERIPHERAL PUMP, IN PARTICULAR FOR FEEDING FUEL FROM FEED TANK TO INTERNAL COMBUSTION ENGINE OF MOTOR VEHICLE

BACKGROUND OF THE INVENTION

The invention relates to a peripheral pump

From German Patent Application DE 40 20 521 A1, a peripheral pump is known that includes a circular-cylindrical impeller revolving in a pump chamber; on at least one of its two end faces, the impeller has a ring of vanes spaced apart from one another in the circumferential direction of the impeller, and viewed in terms of the longitudinal section through the pump, a bottom of the groovelike gap between two adjacent vanes forms a circular segment whose center is virtually identical to the center of another circular segment that is formed by the bottom of an annular feed conduit, which is disposed facing the ring of vanes, each in one wall of the pump chamber. Peripheral pumps of this kind, even after only a relatively short time in operation, show that the impeller is subject to considerable wear, which is due to an axial force that builds up in the peripheral pump, acts on the impeller, and presses the impeller in particular against an intake-side wall of an intake cap. Such a peripheral pump also has poor startup performance. Moreover, the axial force that builds up in the fuel feed unit leads to poor noise abatement.

SUMMARY OF THE INVENTION

The peripheral pump according to the invention has the advantage over the prior art that a pressure force acting on the impeller counter to the axial force can be embodied in the pressure region, so that the total of the axial forces acting on the impeller is virtually zero. As a result, the impeller can rotate freely in the pump chamber, so that virtually wear-free rotation between the impeller and the walls forming the pump chamber is made possible, and hence substantially better noise abatement is attained as well.

Depending on the specific use, the operating pressure prevailing in the pressure region can be determined by varying the angle between a connecting conduit and the intake opening of the feed conduit. As the angle or travel distance increases, a higher pressure builds up in the feed conduit; at the end of the feed conduit at the outlet opening, it may amount to as much as 3 bar, for instance. By the disposition of the connecting conduit at a certain angle between the intake opening and the outlet opening, the pressure shifted to the pressure region and prevailing in it, which acts counter to the axial force acting on the impeller, is adjustable.

An advantageous further feature of the invention is that, according to which a large-diameter pressure face extending radially of a cylindrical segment near the shaft of the impeller is provided on a wall of the pump chamber on the intake side; this pressure face is embodied as large compared with the outlet-side pressure region. As a result it is attainable that when the peripheral pump starts up, a greater force can be built up in the intake-side pressure region than in the outlet-side pressure region, so that the impeller runs on the intermediate housing and as a result a substantial improvement in noise abatement can be attained.

BRIEF OF THE EXEMPLARY EMBODIMENT

One exemplary embodiment of the invention is shown in the drawings and described in further detail in the ensuing description. Shown are:

FIG. 1, a fuel feed unit with a peripheral pump shown in partial longitudinal section;

FIG. 2, a schematic sectional view taken along the line II—II of FIG. 1; and FIG. 3, a schematic sectional view taken along the line III—III of FIG. 1.

Description of Preferred Embodiments

Figure 1:
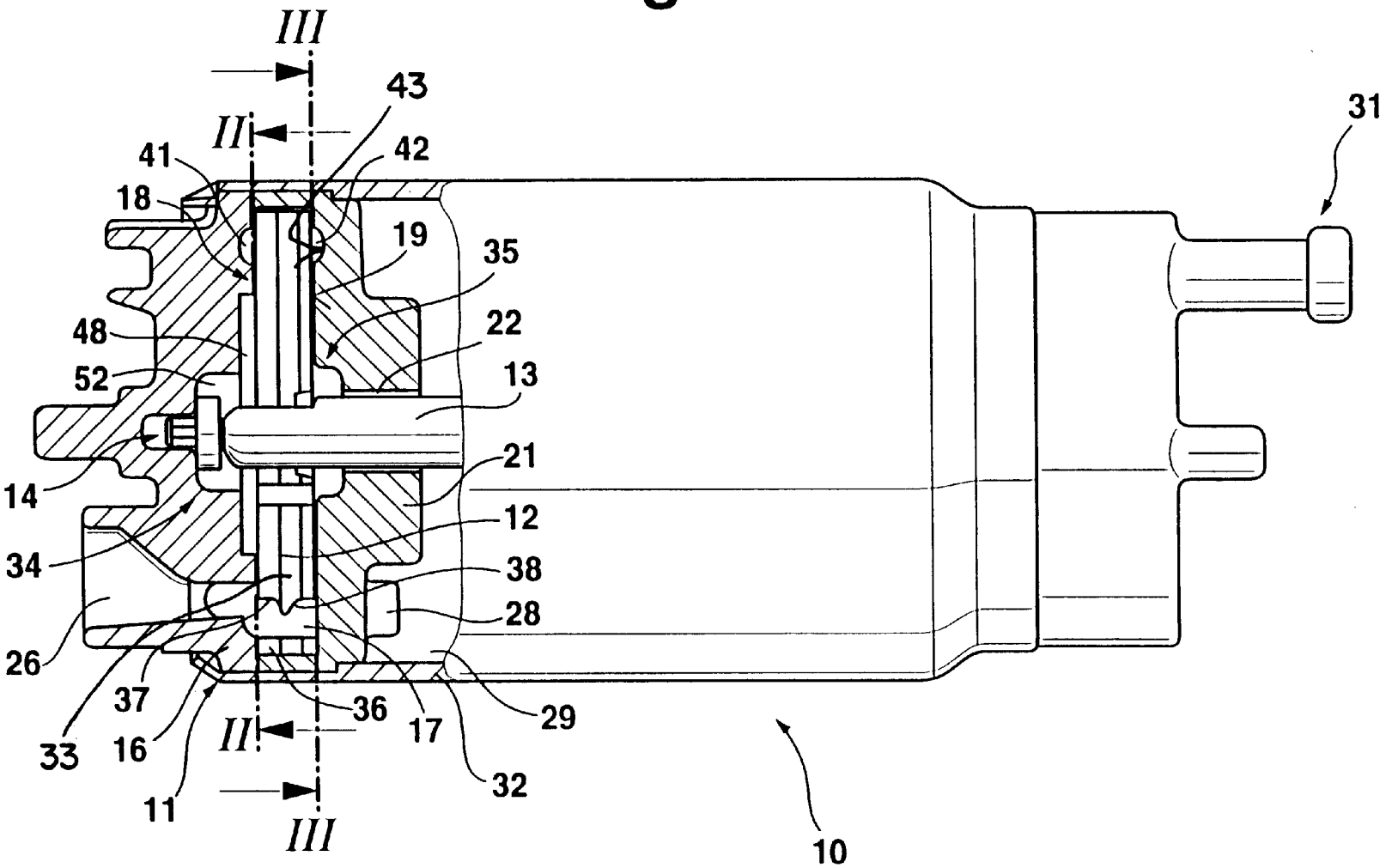

A unit 10 shown in FIG. 1 serves to feed fuel from a feed tank, not shown, to an engine, also not shown, of a motor vehicle. The fuel feed unit 10 has a flow pump 11, whose impeller 12 is connected in a manner fixed against relative rotation by a shaft 13 driven by an electric drive motor, not shown. The shaft 13 passes through the impeller 12 and rests on a bearing trunnion 14, which is disposed on an intake cap 16. The intake cap 16 closes off the fuel feed unit 10 on its intake-side end face. The impeller 12 is disposed in a pump chamber 17, which is defined on both ends, in terms of the axial longitudinal direction of the impeller 12 by at least two adjacent walls 18 and 19. The wall 18 is formed by the face of the intake cap 16 oriented toward the impeller 12. An intermediate housing 21 facing the intake cap 16 has the second wall 19 that forms the peripheral pump 17. The wall 19 has a bearing point 22 for the shaft 13.

During the operation of the feed unit 10, the flow pump 11 aspirates fuel through an intake neck 26 and forces this medium, via a pump outlet 28 in the intermediate housing 21, into a chamber 29 in which the electric motor, not shown, is accommodated. From there, the fuel is delivered to the engine via an outlet or compression neck 31.

Since both the flow pump 11 and the electric motor, not shown, are accommodated in the same housing 32 which is provided with an intake neck 26 and an outlet neck 31, and the fuel thus flows through the fuel feed unit 10, the fuel feed unit 10 at the same time forms part of the feed line from the feed tank to the engine.

The impeller 12 of the flow pump 11 has a disklike central region 33, which is connected directly to the shaft 13; a central bearing bush can advantageously be provided. The impeller 12, or its central region 33, has many radial vanes, which on their free ends remote from the central region 33 are connected to one another by an encompassing ring 36, although this is not absolutely necessary. The vanes are provided on at least one end face of the impeller and are, formed in that lands remain between apertures of the impeller 12 that are disposed on a common pitch circle; these lands define the apertures in the circumferential direction. The axis of each aperture extends parallel to the axis of rotation of the impeller 12. The groove bottom between the vanes is advantageously formed by two circular segments 37, 38, which merge smoothly with one another in the middle region of the impeller 12.

One nearly annular feed conduit 41, 42 is disposed in each of the chamber walls 18, 19. The bottom 43 of the feed conduit 41, 42 is also shaped like a segment of a circle. Advantageously, the circular segment 37 merges fluidly with the circular segment of the feed conduit 41, and the circular segment 38 likewise merges smoothly with the circular segment of the feed conduit 42, because they are formed by a common center with the same radius.

Figure 2:
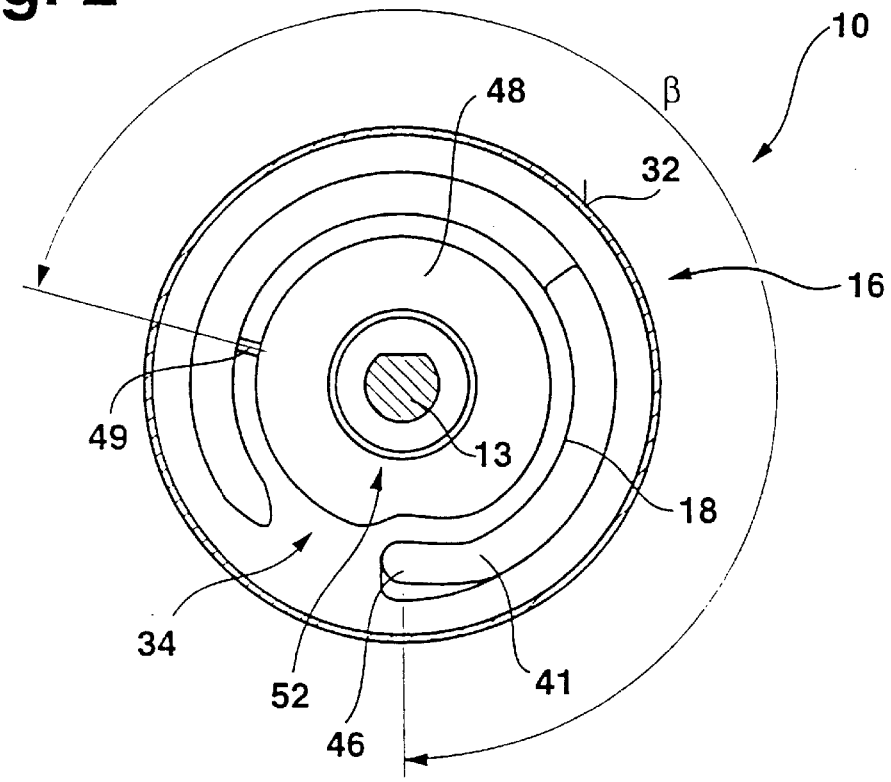

In FIG. 2, a schematic sectional view of the intakeside wall 18 of the intake cap 16 is shown, taken along the line II—II. The feed conduit 41 is embodied as a portion of a circular ring that spans an angle of approximately 270° to 340°. The beginning of the feed conduit 41, which in the exemplary embodiment is shown in a six o'clock position and faces an intake opening 46 of the intake neck 26, extends counterclockwise to approximately an eight o'clock position. As the progress increases from the six o'clock position to the approximately eight o'clock position, a steady buildup of pressure takes place in the feed conduit 41; at the end of the feed conduit 41, the pressure is in a range of approximately 3 bar. The medium is delivered at this pressure to the chamber 29 via an outlet opening 47.

Inside the feed conduit 41, a pressure region 34 is provided, which is operatively connected directly to the impeller 12. The pressure region 34 is provided on at least one of the walls 18, 19 and, embodied substantially circularly, in the form of a pressure face 48 that is formed as an indentation in the wall 18. This pressure face 48 extends radially, advantageously over the largest possible region that is defined by the feed conduit 41, at least part way to the feed conduit. Between the pressure face 48 and the feed conduit 41, a connecting conduit 49 is provided, which is embodied extending radially between the feed conduit 41 and the pressure face 48.

The connecting conduit 49 is disposed at approximately the nine o'clock position, which corresponds to an angle β of 270°; as a result, the pressure of the feed conduit 41 that prevails in the nine o'clock position is carried over to the pressure face 48, and the axial force acting on the impeller 12 can thus be determined. The connecting conduit 49 may also be disposed in some other position between the intake opening 46 and the outlet opening 47; preferably an angle β of between 180° and 300° is provided. The positioning can be selected for a specific application, depending on the structural sizes of the peripheral pump, the pumping capacity of the flow pump, of the electric motor or the like. The connecting conduit 49 is embodied in its cross section as precisely large enough to create a flow cross section that is required for the pressure buildup in the pressure region 34.

Figure 3:
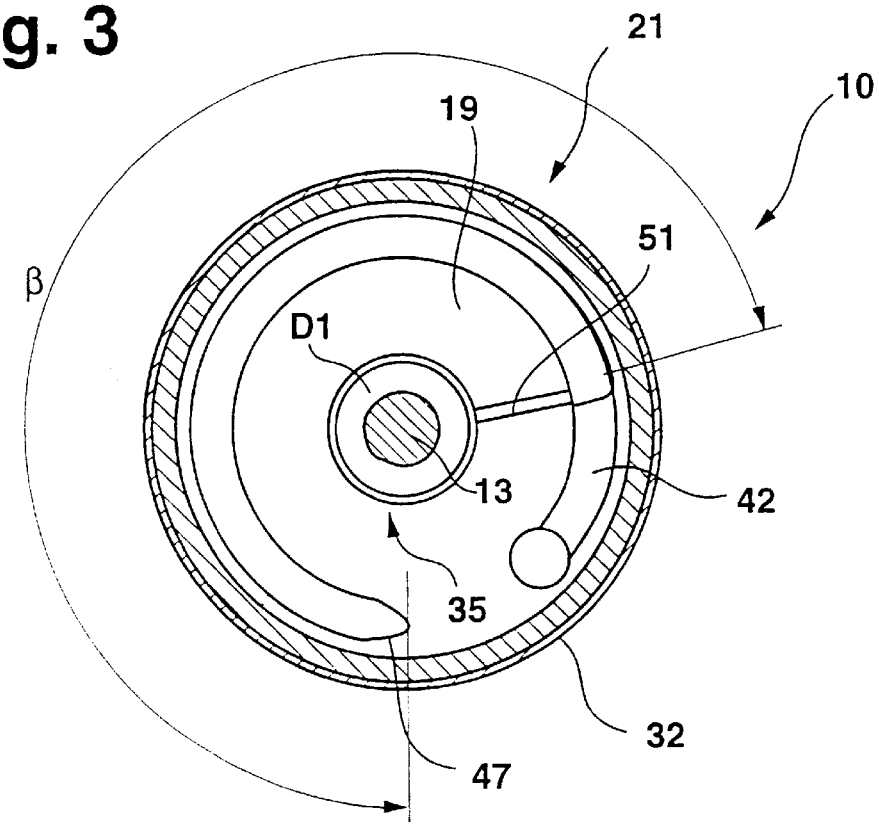

FIG. 3 shows a plan view on the wall 19 of the intermediate housing 21 along the line III—III of FIG. 1. The feed conduit 42 corresponds to the feed conduit 41. At its beginning, in the six o'clock position, the medium to be pumped flows in and passes clockwise to the outlet opening 47 by way of which the medium is removed to the chamber 29. The pressure in the feed conduit 42 increases in the clockwise direction. A connecting conduit 51 extends radially inward from the supply conduit 42 and communicates with a pressure region 35. This pressure region is disposed substantially facing the pressure region 34. The connecting conduit 51 is advantageously disposed at the same angle as the connecting conduit 49 in the intake cap 16. As a result, equal force conditions on the impeller 12 can be created. The pressure region 35 of the intermediate housing 21 is embodied cylindrically and has a diameter DI, which substantially corresponds to the cylindrical segment 52 of the intake cap 16, which is embodied deeply opposite the pressure region 34. The pressure region 34 encompasses both the cylindrical segment 52 and the disklike pressure face 48, which extends across a relatively large circular area of the impeller 12 and can transmit a uniform force per unit of surface area to the impeller 12.

Alternatively, a continuous transition between the pressure face 48 and the cylindrical segment 52 of the pressure region 34 may also be provided. The pressure region 34 is advantageously made large, so that the pressure prevailing in the pressure region 34, 35 can be varied by way of the positioning of the connecting conduit 49, 51 relative to the intake opening 46 at an angle β. As a result, in a simple way involving measurement technology or empirically, an optimal disposition of the connecting conduit 49, 51 at an angle β to the intake opening 46 can be made possible. The pressure region 34, 35 can be formed as at least a depression 48, 52, 53 that extends axially in at least one of the walls 18, 19.

We claim:

1. A peripheral pump, in particular for pumping fuel from a feed tank to an internal combustion engine of a motor vehicle, having a pump chamber (17), formed by at least two adjacent walls (18, 19), in which chamber a circular-cylindrical impeller (12) is disposed to revolve, which impeller, on at least one of its two end faces, has a ring of vanes spaced apart from one another in the circumferential direction of the impeller (12), a nearly annular feed conduit (41, 42) being formed in the wall (18, 19) facing the ring of vanes, characterized in that on at least one of the two walls (18, 19), a pressure region (34, 35) is provided, which is directly operatively connected to the impeller (12) and can be acted upon by a pressure that builds up in the feed conduit (41, 42), a connecting conduit (49, 51) is provided between the pressure region (34,35) and the feed conduit (41,42), the connecting conduit (49,51) in the circumferential direction of the impeller (12) is connected with the feed conduit (41, 42) after a beginning of the feed conduit (41, 42) so that in a region in which the pressure region (34, 35) is connected with the feed conduit (41, 42), a pressure build up is obtained in the feed passage (41, 42).

2. The peripheral pump of claim 1, characterized in that the pressure region (34, 35) is embodied at least as an indentation (48, 52; 53) extending in the axial direction in at least one of said wall (18, 19).

3. The peripheral pump of claim 1, characterized in that the pressure region (34, 35) is embodied as a pressure face (48) extending radially outward from a shaft (13) of the impeller (12) at least part way to the feed conduit (41, 42).

4. The peripheral pump of claim 1, characterized in that the connecting conduit (49, 51) is disposed extending radially in the plane of the feed conduit (41, 42).

5. The peripheral pump of claim 1, characterized in that the feed conduit (41, 42) is embodied, in axial cross section, at least as an annular segment in the form of three-quarters of a circle, and the connecting conduit (49, 51) is disposed at an angle (β) to an intake opening (46) of the feed conduit (41, 42).

6. The peripheral pump of claim 1, characterized in that with an increasing angle (β) between an intake opening (46) and the connecting conduit (49, 51), a greater pressure can be built up in the pressure region (34, 35) and exerted on the impeller (12).

7. The peripheral pump of claim 5, characterized in that the connecting conduit (49, 51) is disposed at an angle of from 180° to 300° with respect to an outlet opening (46) of the feed conduit (41, 42).

8. The peripheral pump of claim 1, characterized in that the pressure region (34, 35) is embodied in steplike fashion, with an indentation becoming narrower as it extends radially outward.

9. The peripheral pump of claim 1, characterized in that the pressure region (34) has a disklike segment as a pressure face (48), with a cylindrical segment (52) in one of side wall (18), which segment is located near the shaft (13).

10. The peripheral pump of claim 1, characterized in that the pressure region (34) disposed an intake-side wall (18) is embodied as large, compared with the pressure region (35) disposed on an outlet-side wall (19).

11. The peripheral pump of claim 1, characterized in that an angle (β) between an intake opening (46) and connecting conduit (49, 51) in the feed conduit (41, 42) is the same in both an intake-side wall (18) and an outlet-side wall (19).

* * * * *